US007597564B2

(12) United States Patent
Matthias et al.

(10) Patent No.: US 7,597,564 B2
(45) Date of Patent: Oct. 6, 2009

(54) TOOLLESSLY MAKABLE AND BREAKABLE ELECTRICAL CONNECTION

(75) Inventors: Wolf Matthias, Stuttgart (DE); Marcin Rejman, Waiblingen (DE)

(73) Assignee: Robert Bosch GmbH, Stuttgart (DE)

( * ) Notice: Subject to any disclaimer, the term of this patent is extended or adjusted under 35 U.S.C. 154(b) by 205 days.

(21) Appl. No.: 11/696,433

(22) Filed: Apr. 4, 2007

(65) Prior Publication Data

US 2007/0238331 A1 Oct. 11, 2007

(30) Foreign Application Priority Data

Apr. 11, 2006 (DE) ..... 10 2006 016 888
Sep. 29, 2006 (DE) ..... 10 2006 046 471

(51) Int. Cl.
*H01R 4/66* (2006.01)

(52) U.S. Cl. ..... 439/108; 428/88; 439/66

(58) Field of Classification Search ..... 428/88; 439/66

See application file for complete search history.

(56) References Cited

U.S. PATENT DOCUMENTS 4,746,300 A 5/1988 Thevenin
5,176,535 A 1/1993 Redmond et al.
5,885,683 A * 3/1999 Swift ..... 428/88
6,659,778 B2 * 12/2003 Li ..... 439/66
7,251,857 B2 * 8/2007 Caruso ..... 15/377
2005/0136280 A1 * 6/2005 Kuhlmann-Wilsdorf ..... 428/611

FOREIGN PATENT DOCUMENTS

| | | |
|---|---|---|
| EP | 0 369 772 | 5/1990 |
| GB | 1191234 | 5/1970 |
| GB | 2 062 364 | 5/1981 |
| GB | 2 101 415 | 1/1983 |
| GB | 2 351 616 | 1/2001 |
| GB | 2 360 401 | 9/2001 |
| GB | 2 419 477 | 4/2006 |

* cited by examiner

*Primary Examiner*—Briggitte R Hammond
(74) *Attorney, Agent, or Firm*—Michael J. Striker

(57) ABSTRACT

A toollessly makable and breakable electrical connection between a current source, in particular a removable energy storage device, and an electrical consumer, has at least one contact pair comprised of two contact elements, one of which is connected to the current source and one of which is connected to the consumer. In order to reduce the transition impedance in the contact pair and to reduce the current-induced heating of the contact pair, at least one contact element has a multitude of individual small-area contact points that are electrically connected in parallel. For example, the multitude of contact points is implemented in the form of fibers composed of an electrically conductive material, which are combined in bristle brush or paintbrush fashion to form a fiber brush.

15 Claims, 4 Drawing Sheets

TOOLLESSLY MAKABLE AND BREAKABLE ELECTRICAL CONNECTION

CROSS-REFERENCE TO A RELATED APPLICATION

The invention described and claimed hereinbelow is also described in German Patent Application DE 102006016888 filed on Apr. 11, 2006 and DE 102006046471.0 filed on Sep. 29, 2006. These German Patent Applications, which subject matter is incorporated here by reference, provides the basis for a claim of priority of invention under 35 U.S.C. 119(a)-(d).

BACKGROUND OF THE INVENTION

The invention is based on a toollessly makable and breakable electrical connection between a current source, in particular a removable energy storage device, and an electrical consumer.

Known electrical connections of this kind in electric handheld power tools, e.g. cordless screwdrivers or cordless drills, between a removable storage battery, referred to for short as a battery, and an electric motor are typically comprised of two contact pairs, each with two contact elements, of which two contact elements belonging to different contact pairs are situated in the machine housing and the two other contact elements of different contact pairs being situated in the battery housing that can be detached from the machine housing. In each contact pair, the one contact element is embodied as a metal plate and the other contact element is composed of several resilient metal tabs that are slid onto the metal plate when the battery housing is placed onto the machine housing. In the contact region, the contact tabs have a bead or bulge so that the contact elements press against each other with a definite pressure. In this embodiment of the electrical connection, the electrical contact between the contact elements is produced via a line or a point, in any case, over a relatively small area. This generates contact losses, which result in an intense heating of the contact points and a power loss.

SUMMARY OF THE INVENTION

Accordingly, it is an object of the present invention to provide a toollessly makable and breakable electrical connection which is a further improvement of the existing electrical connections.

In keeping with these objects and with others which will become apparent hereinafter, one feature of the present invention resides, briefly stated in a toollessly makable and breakable electrical connection between a current source and an electrical consumer, comprising at least one contact pair including two contact elements with one of said contact elements connectable to the current source and another of said contact elements connectable to the consumer, at least one of said contact elements of said contact pair having a multitude of individual small-area contact points that are electrically connected in parallel.

When the electrical connection is designed in accordance with the present invention it has the advantage that the multitude of parallel-connected contact points significantly reduces the transition impedance between the contact elements and as a result, the contact losses decrease. By distributing the current load to the multitude of contact points, each contact point is placed under only a slight load and therefore heats up by a relatively small amount.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
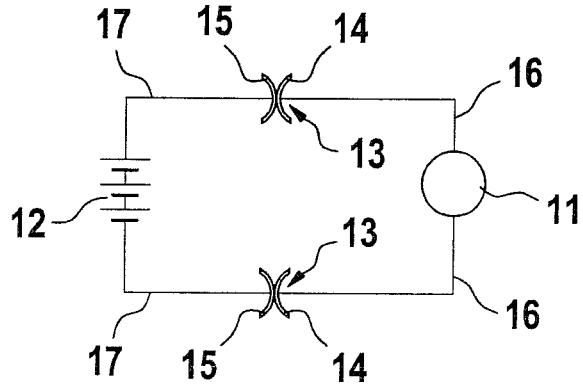
FIG. 1 is a circuit diagram of a storage battery and a current consumer as well as a toollessly makable and breakable electrical connection between them, comprised of two contact pairs.

In the circuit diagram shown in FIG. 1, an electric consumer 11 is connected to a power source 12 via a toollessly makable and breakable electrical connection. For example, the electric consumer is the electric drive motor of a cordless drill/screwdriver that is situated in the machine housing and the power source 12 is a removable storage battery or battery that is contained in a battery housing. Placing the battery housing against the machine housing produces the electrical connection and detaching the battery housing from the machine housing cuts or disconnects the electrical connection.

The electrical connection correspondingly has two equivalent contact pairs 13, each with two contact elements 14, 15. For example, the contact elements 14 of the contact pair 13 are situated in the machine housing and the contact elements 15 of the contact pair 13 are situated in the battery housing, but the arrangement can also be reversed. The electrical consumer 11 is connected via two electrical lines 16 to the contact elements 14 of the two contact pairs 13 and the power source 12 is connected via two electrical lines 17 to the contact elements 15 of the two contact pairs 13. FIGS. 2 through 11 show various exemplary embodiments for the design of the contact pairs 13. All of the exemplary embodiments share the trait that at least one contact element 14, 15 in a contact pair 13 has a multitude of individual, small-area contact points that are electrically connected in parallel.

Figure 2:
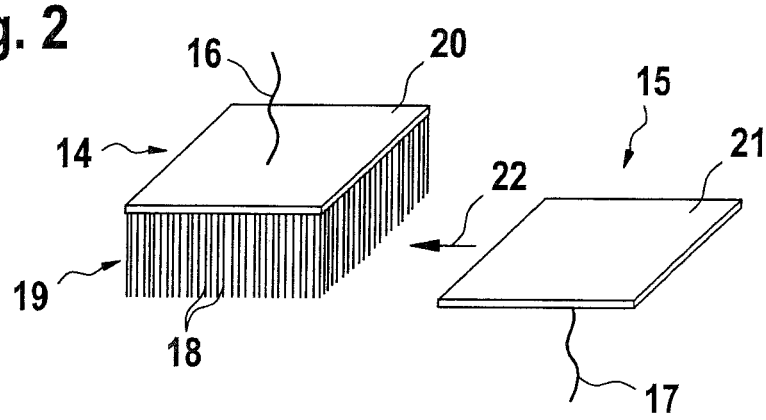
FIG. 2 is a perspective depiction of the two contact elements of a contact pair in FIG. 1, FIGS. 3 and 4 each show a side view of the contact elements of a contact pair in FIG. 1, according to a second and third exemplary embodiment.

In the exemplary embodiment of FIG. 2, the multitude of electrically parallel-connected contact points on the contact element 14 are implemented in that fibers 18 comprised of electrically conductive material are combined in bristle brush or paintbrush fashion to form a fiber brush 19. The fibers 18 are joined together at the one end of the fibers 18 by means of an electrically conductive plate 20 connected to the electric line 16 leading to the consumer 11. The other contact element 15 of each contact pair 13 is a metal plate 21 connected to the electrical line 17, which plate, in order to produce the electrical connection, is slid in the direction of the arrow 22 in FIG. 2 across the free ends of the fibers 18 of the fiber brush 19 so that the end surface of the fiber brush 19 is pressed against the metal plate 21. In this case, the end surfaces of the free fiber ends constitute the multitude of parallel-connected contact points between the two contact elements 14, 15 of each contact pair 13. In a manner not shown in detail here, the fibers 18 are preferably embedded in an elastic material in order on the one hand, to hold the fibers 18 in position and on the other hand, to be able to set a definite pressure between the contact elements 14, 15.

Figure 3:
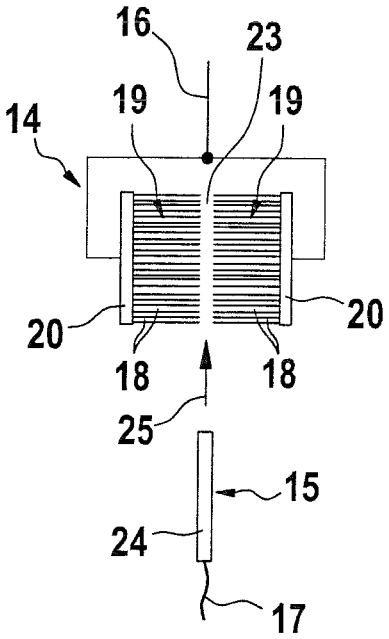

In the exemplary embodiment of a contact pair 13 shown in FIG. 3, the one contact element 14 has two fiber brushes 19 electrically connected in parallel, each of which is shown in FIG. 2 and has been explained above. The multitude of fibers 18 combined to form the fiber brush 19 are each in turn affixed to the electrically conductive plate 20 at one fiber end. The two fiber brushes 19 are situated in opposition to each other so that the plates 20 are situated on the sides of the fiber brushes 19 that are oriented away from each other. A gap 23 is left between the two fiber brushes 19. The other contact element 15 is embodied in the form of a blade 24 comprised of electrically conductive material and when the electrical connection is being made, is slid in the direction of the arrow 25 in FIG. 3 into the gap 23 and contacts the free fiber ends of the two fiber brushes 19 therein. Here, too, the fibers 18 of the two fiber brushes 19 can be embedded in an elastic material. Here, too, the free fiber ends of the fibers 18 that press against the blade 24 constitute the multitude of contact points between the two contact elements 14, 15.

Figure 4:
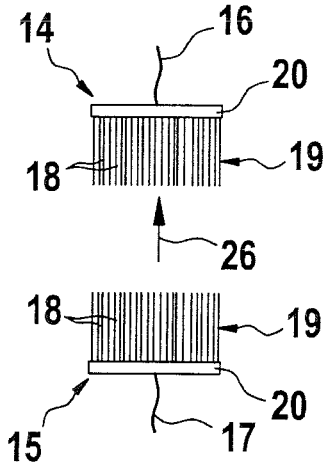

In the exemplary embodiment in FIG. 4, each contact element 14, 15 of the contact pairs 13 is embodied in the form of the contact element 14 shown in FIG. 2 and described in conjunction with FIG. 2. Each contact element 14, 15 therefore has a fiber brush 19 comprised of a multitude of fibers 18 composed of electrically conductive material, which are joined together mechanically and electrically at their fiber ends on one end by means of the electrically conductive plate 20. The two fiber brushes 19 of the contact elements 14, 15 are arranged with their free brush ends oriented toward each other. In order to produce the electrical connection, the contact element 15 is moved in the direction of the arrow 26 in FIG. 4 toward the contact element 14; the fiber brushes 19 are slid into each other.

The multitude of contact points between the contact elements 14, 15 are now constituted by the circumference surfaces of the fibers 18 contacting one another. If the fiber brushes 19 of the two contact elements 14, 15 are slid into each other until the free fiber ends press against the plate 20 of the respective other fiber brush 19, then the contact points between the contact elements 14, 15 are also implemented in the form of the free fiber ends of the fibers 18.

Figure 5:
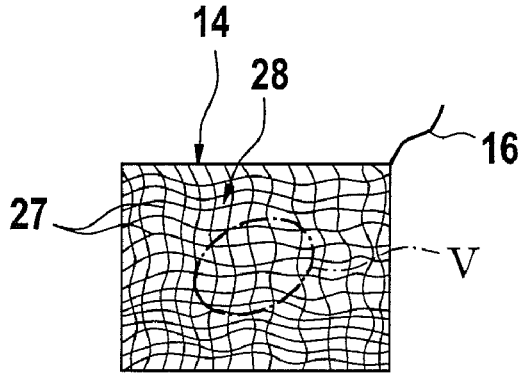
FIG. 5 is a top view of a contact element of a contact pair in FIG. 1, according to a fourth exemplary embodiment.
Figure 6:
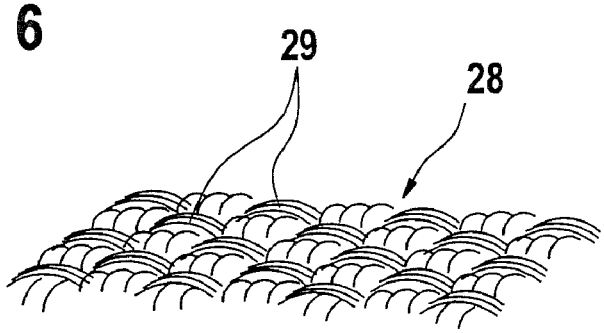
FIG. 6 is an enlarged perspective top view of the detail V in FIG. 5.

In the contact element 14 of a contact pair 13 schematically depicted in the top view in FIG. 5, the multitude of contact points are implemented in the form of fibers 27 composed of electrically conductive material that are combined to form a woven, a knit, or a felt-like nonwoven. For example, FIG. 5 schematically depicts a top view of a copper netting. The detail V of the copper netting 28 is schematically depicted in a perspective view in FIG. 6 in order to illustrate the convex netting bulges 29 that are formed in the copper netting. These netting bulges 29 constitute the multitude of contact points between the contact elements 14, 15. The other contact element 15 not shown in the exemplary embodiment in FIG. 5 can be embodied in the same way or can also be constituted by a plate comprised of electrically conductive material against which the netting bulges 29 of the copper netting 28 press. An example for such a copper netting 28 is in the automotive field in which the netting is used as a ground connection of the car battery.

Figure 7:
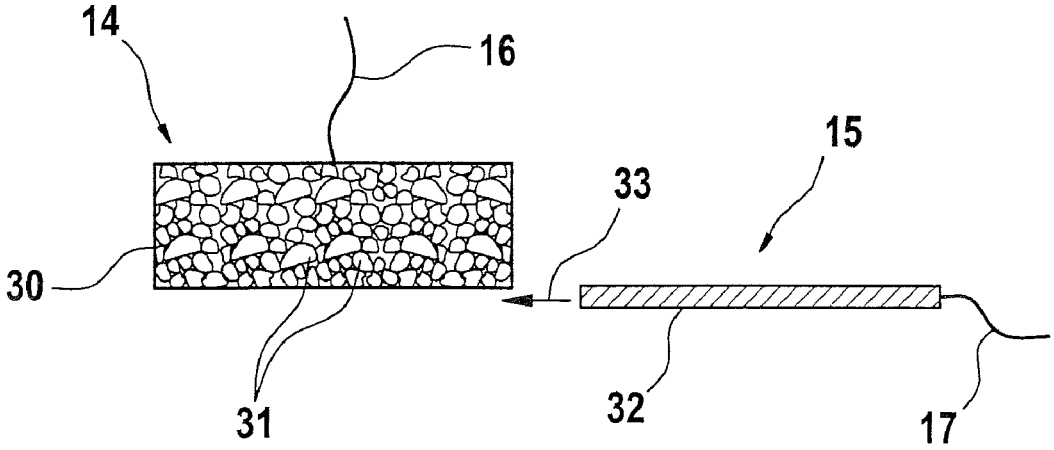
FIG. 7 is a longitudinal section through the contact elements of a contact pair in FIG. 1, according to a fifth exemplary embodiment.

In the exemplary embodiment of a contact pair 13 depicted in FIG. 7, the multitude of contact points are implemented in the form of the contact element 14 by means of reciprocally touching powder or granulate particles composed of electrically conductive material. These powder or granulate particles are embedded in a body 30 composed of an electrically conductive, elastic material. In order to assure the reciprocal contact of a multitude of powder or granulate particles, the packing density of the powder or granulate in the body 30 is relatively high. The body 30 is attached to the connecting line 16. The other contact element 15 is composed of a stiff metal strip 39, which is slid along the underside of the body 30 in the direction of the arrow 33 in FIG. 7 to produce the electrical connection so that the elastic body 30 is pressed against the metal strip 32. Alternatively, the contact element 15 can be embodied in the same way as the contact element 14.

Figure 8:
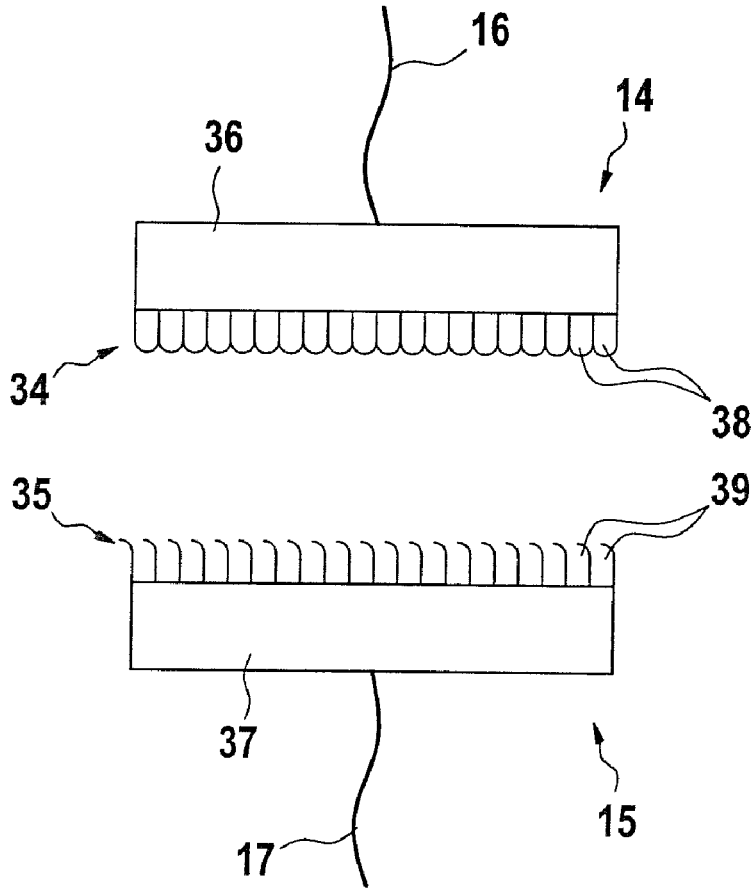
FIG. 8 is a side view of the contact elements of a contact pair in FIG. 1, according to a sixth exemplary embodiment.

In the exemplary embodiment in FIG. 8, the multitude of contact points between the two contact elements 14, 15 of a contact pair 13 are comprised of the adhesion elements 34, 35 of a current-carrying hook-and-loop fastener. When pressed into each other, the adhesion elements 34, 35 produce an intimately engaging adhesive connection to each other, which can be detached again by pulling them apart. The adhesion elements 34, 35 are composed of electrically conductive material and are situated on the reciprocally opposed undersides of two electrically conductive supports embodied in the form of hook-and-loop strips 36, 37. The hook-and-loop strips 36, 37 are connected to the electrical lines 16, 17. In the exemplary embodiment in FIG. 8, the adhesion elements 34 provided on the upper hook-and-loop strip 36 that constitutes the contact element 14 are embodied as loops 38 and the adhesion elements 35 provided on the lower hook-and-loop strip 37 that constitutes the contact element 15 are embodied as hooks 39 that hook into the loops 38. Naturally, it is also possible to use other forms of hook-and-loop fastener, such as hook and fleece strips, mushroom and velour strips, mushroom and fleece strips, or mushroom and mushroom strips.

Figure 9:
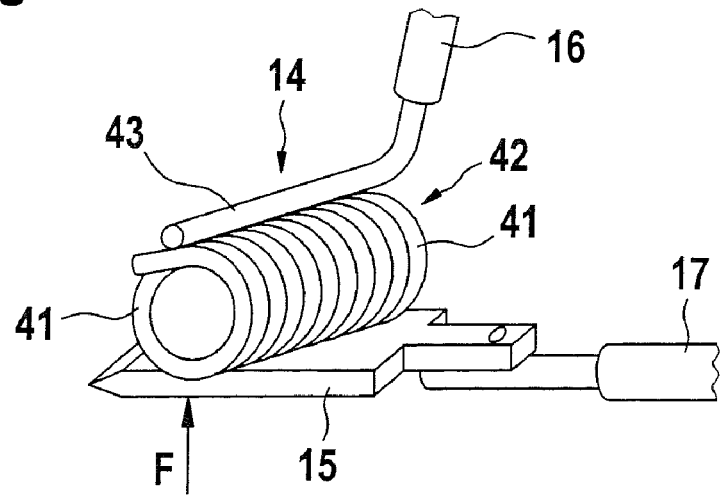
FIG. 9 is a perspective representation of the two contact elements of a contact pair, according to a seventh exemplary embodiment.

In the exemplary embodiment of a contact pair 13 for making a detachable electrical connection shown in FIG. 9, the multitude of contact points between the contact elements 14, 15 are implemented in the form of at least one row of coils 41 situated next to one another, composed of electrically conductive material, which are situated on the contact element 14 and rest with a coil section against the other contact element 15, which is embodied as flat. In order to generate a sufficient contact pressure between the contact elements 14, 15, a compressive force F acts on at least one of the contact elements 14, 15—on the contact element 15 in the exemplary embodiment in FIG. 9. As schematically depicted in FIG. 9, the row of coils 41 situated next to one another is implemented in the form of a helix 42.

Figure 10:
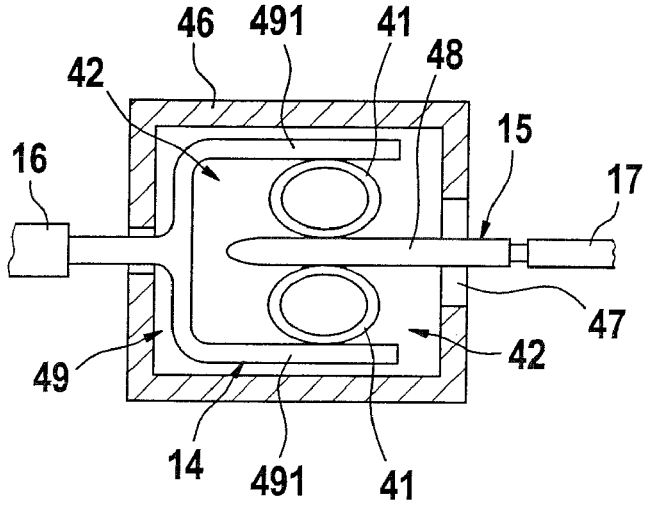
FIG. 10 is a section through a female connector with a contact pair, according to an eighth exemplary embodiment.

A conductor bridge 43 connected to the electrical line 16 and extending parallel to the helix axis contacts the individual coils 41 of the helix 42 and is mechanically connected to them, e.g. by means of welding or soldering. All of the coils 41 of the helix 42 have the same size coil radius and are coaxially aligned so that all of the coils 41 rest with the same contact pressure against the flat contact element 15. In the exemplary embodiment in FIG. 9, the coils 41 are embodied as circular. But they can also be non-round, e.g. oval, as shown in FIG. 10. In that case, the coils 41 are preferably oriented so that each of them rests with a less curved coil section against the flat contact element 15. This non-round cross section of the coils makes it possible to advantageously embody the elastic behavior of the coils 41 and therefore the contact pressure. In a manner not shown in the drawings, the coils 41 can also be embodied in the form of an undulating ring so that each coil produces several contact points on the contact element 15.

Figure 11:
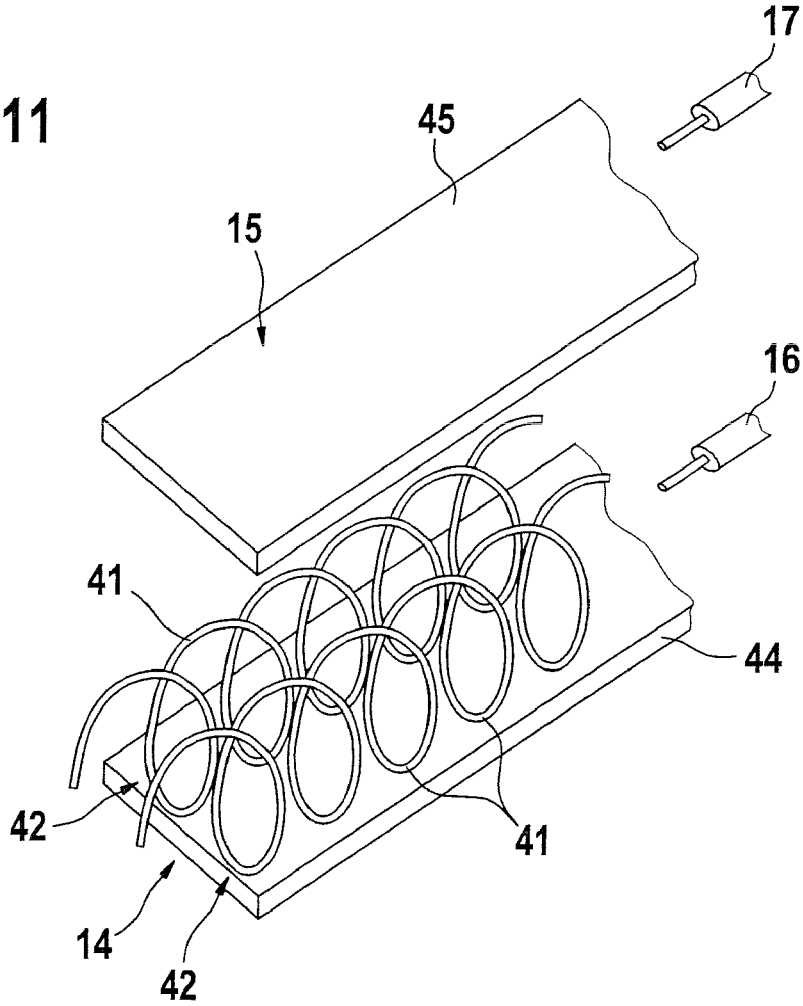
FIG. 11 shows a detail of a perspective representation of the two contact elements of a contact pair, according to a ninth exemplary embodiment.

In order to increase the number of contact points, several helices 42 can be situated next to one another, with parallel helix axes. All of the helices 42 are electrically connected in parallel and are connected to the conductor 16; this can occur, for example, in that the conductor bridge 43 is embodied as plate-shaped and extends over several helices 42, perpendicular to the helix axes. FIG. 11 depicts an electrical connection of this kind. The parallel spacing of the two helices 42, however, is selected as smaller than the diameter of the coils 41 so that in this case, the coils 41 of the two helices 42 partially mesh with one another. All of the helices 42 are placed on a contact plate 44 of the contact element 14 and all of the coils 41 are attached to the contact plate 44. The contact plate 44 is connected to an electrical line 16 so that all of the helices 42 are electrically connected in parallel. The other flat contact element 15 is likewise embodied as a contact plate 45 and is connected to the electrical line 17. To produce the electrical connection, the contact plate 45 is pressed onto the coils 41 of the helices 42 or is slid along the helices 42 parallel to the contact plate 44, with an effective compressive force oriented perpendicular to the sliding direction.

FIG. 10 depicts a plug connection that is implemented by means of the principle of the electrical connection between the contact elements 14 and 15 of a contact pair 13 that is schematically depicted in FIG. 9 and described above. The contact element 14 is integrated into a plug receptacle 46 that has a receptacle opening 47 into which the other contact element 15, embodied as a plug blade 48, can be plugged. The contact element 14 is comprised of a U-shaped clip 49 with two clip legs 491 spaced apart from each other. Each of the leg surfaces oriented toward each other has a respective helix 42 attached to it by its coils 41, which are oval in cross section. When the plug connection is disconnected, the spring tension causes the two clip legs 491 to spring inward so that the coils 41 of the two helices 42 are spaced apart by only a small gap. To produce the plug connection, the plug blade 48 is slid in through the receptacle opening 47 and in between the two helices 42. This pushes the two clip legs 491 outward so that there is a sufficient contact pressure between the plug blade 48 and the coils 41 of the helices 42. The clip 49 is connected to the electrical line 16 and the plug blade 48 is connected to the electrical line 17.

It will be understood that each of the elements described above, or two or more together, may also find a useful application in other types of constructions differing from the type described above.

While the invention has been illustrated and described as embodied in a toollessly makable and breakable electrical connection, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A toollessly makable and breakable electrical connection between a current source and an electrical consumer, comprising at least one contact pair including two contact elements with one of said contact elements connectable to the current source and another of said contact elements connectable to the consumer, at least one of said contact elements of said contact pair having a multitude of individual small-area contact points that are electrically connected in parallel, wherein said multitude of said contact points are configured as reciprocally touching elements selected from the group consisting of powder particles, granulated particles, and fiber cuttings composed of an electrically conductive material and embedded in a body composed of a nonconductive material, wherein said multitude of said reciprocally touching contact points of said two contact elements are configured as current-carrying adhesion elements that produce a detachable adhesive connection.

2. A toollessly makable and breakable electrical connection as defined in claim 1, wherein said detachable adhesive connection is configured as a current-carrying hook-and-loop fastener.

3. A toollessly makable and breakable electrical connection as defined in claim 1, wherein said adhesion elements provided on one of said contact elements are configured as loops, and said adhesion elements provided on the other contact element are configured as hooks that hook into said loops.

4. A toollessly makable and breakable electrical connection as defined in claim 1, wherein said adhesion elements composed of electrically conductive material are situated on reciprocally opposed undersides of two electrically conductive supports.

5. A toollessly makable and breakable electrical connection as defined in claim 4, wherein said two electrically conductive supports are configured as strips.

6. A toollessly makable and breakable electrical connection between a current source and an electrical consumer, comprising at least one contact pair including two contact elements with one of said contact elements connectable to the current source and another of said contact elements connectable to the consumer, at least one of said contact elements of said contact pair having a multitude of individual small-area contact points that are electrically connected in parallel, wherein said multitude of contact points of one of said contact elements are configured as at least one row of coils situated next to one another composed of an electrically conductive material, which rest against the other of said contact elements configured as a flat element.

7. A toollessly makable and breakable electrical connection as defined in claim 6, wherein said coils have a same size coil radius and are coaxially aligned.

8. A toollessly makable and breakable electrical connection as defined in claim 6, wherein said coils are configured as circular coils.

9. A toollessly makable and breakable electrical connection as defined in claim 6, wherein each row of said coils is composed of a helix and said helices are electrically connected to each other in parallel.

10. A toollessly makable and breakable electrical connection as defined in claim 6, wherein said coils are non-round and rest with a less curved coil section against said flat contact element.

11. A toollessly makable and breakable electrical connection as defined in claim 10, wherein said coils are configured as oval coils.

12. A toollessly makable and breakable electrical connection as defined in claim 6, wherein said other flat contact element is configured as a plug plate, and said coils of said at least one row of coils are pressed against opposite surfaces of said plate.

13. A toollessly makable and breakable electrical connection as defined in claim 12, wherein said rows of coils pressing against said opposite surfaces of said blade are attached to opposite legs of a spring clip that is prestressed so that it reduces a gap between said legs.

14. A toollessly makable and breakable electrical connection between a current source and an electrical consumer, comprising at least one contact pair including two contact elements with one of said contact elements connectable to the current source and another of said contact elements connectable to the consumer, at least one of said contact elements of said contact pair having a multitude of individual small-area contact points that are electrically connected in parallel, wherein said multitude of contact points of one of said contact elements are configured as at least one row of coils situated next to one another composed of an electrically conductive material, which rest against the other of said contact elements configured as a flat element, wherein several said rows of coils are arranged parallel to one another.

15. A toollessly makable and breakable electrical connection as defined in claim 14, wherein said rows of coils are arranged so that said coils of adjacent rows at least partially mesh with each other.

* * * * *